United States Patent [19]

Woods et al.

[11] Patent Number: 4,696,168

[45] Date of Patent: Sep. 29, 1987

[54] REFRIGERANT SUBCOOLER FOR AIR CONDITIONING SYSTEMS

[75] Inventors: Donald R. Woods; Helga S. Woods, both of Nederland, Tex.

[73] Assignee: Roger Rasbach, Houston, Tex.

[21] Appl. No.: 913,919

[22] Filed: Oct. 1, 1986

[51] Int. Cl.[4] ..... F25B 41/00

[52] U.S. Cl. ..... 62/200; 62/513; 165/145

[58] Field of Search ..... 62/113, 117, 199, 200, 62/513; 165/145

[56] References Cited

U.S. PATENT DOCUMENTS

| | | | |
|---|---|---|---|
| 2,051,971 | 8/1936 | Swart | 62/513 X |
| 2,388,556 | 11/1945 | Lathrop | 62/513 X |
| 2,990,698 | 7/1961 | Grotser | 62/513 X |
| 3,316,961 | 5/1967 | Dorner | 165/145 |
| 4,316,366 | 2/1982 | Manning | 62/200 |
| 4,440,217 | 4/1984 | Stieler | 165/145 X |
| 4,577,468 | 3/1986 | Nunn, Jr. et al. | 62/200 X |

*Primary Examiner*—William E. Tapolcai
*Attorney, Agent, or Firm*—Vinson & Elkins

[57] ABSTRACT

An air conditioning or refrigeration system having a subcooler (18) for subcooling liquid or hot gaseous refrigerant before the refrigerant is supplied to a heat exchanger, such as an evaporator (24) or a condenser (14). The refrigerant subcooler or precooler (18, 18A, 18B) utilized in the method and apparatus of the refrigeration system has an inner cylindrical housing (38, 38A) positioned in concentric relation to an outer cylindrical housing (48, 48A) and forming an annulus (53, 53A) therebetween. A small portion of refrigerant is diverted from the main body of refrigerant at the subcooler (18, 18A) and is passed through an expanison valve (32, 32A) for vaporizing upon entering the subcooler (18, 18A). The diverted vaporized refrigerant passes in heat exchange relation to the refrigerant in the inner housing in two complete passes or laps by first moving along the length of the subcooler (18, 18A, 18B) in one direction, and then reversing its flow path and moving in a reverse direction of travel along the length of the subcooler (18, 18A, 18B) along the annulus (53, 53A) between the inner housing (38, 38A) and the outer housing (48, 48A).

16 Claims, 5 Drawing Figures

REFRIGERANT SUBCOOLER FOR AIR CONDITIONING SYSTEMS

BACKGROUND OF THE INVENTION

This invention relates to an air conditioning or refrigeration system, and more particularly to the method and means for precooling or subcooling refrigerant in a refrigeration or air conditioning system.

Heretofore, subcoolers have been provided in air conditioning systems for subcooling refrigerant. Such subcoolers have usually been provided between the condenser and the evaporator for reducing the temperature of the liquid refrigerant supplied to the evaporator to a temperature lower than the temperature of the liquid refrigerant discharged from the condenser thereby to decrease the air conditioning cycle time and the amperage required for operation of the air conditioning system.

For example, U.S. Pat. No. 4,316,366, to John D. Manning, dated Feb. 23, 1982, and U.S. Pat. No. 4,357,805, to John D. Manning, dated Nov. 9, 1982 are both directed to a flash subcooler in which a portion of liquid refrigerant circulating from the condenser to the evaporator is diverted to the subcooler where it is flashed while the main body of liquid refrigerant flows in a straight line direction through the subcooler in a minimum of time. As the refrigerant changes state from a liquid to a gas, it absorbs heat energy from the refrigerant flowing from the condenser to the evaporator subcooling the main body of liquid refrigerant. The diverted portion of the liquid refrigerant is vaporized or flashed and results in the subcooling of the main body of liquid refrigerant which subsequently enters the evaporator. By subcooling the liquid refrigerant to the evaporator the capacity of a given flow rate to absorb heat energy in the evaporator is increased. The flashed or vaporized refrigerant from both the subcooler and the evaporator are drawn or returned to the compressor through a common suction line.

U.S. Pat. No. 4,577,468, dated Mar. 25, 1986 is likewise directed to a subcooler for subcooling liquid refrigerant from a condenser to an evaporator and diverts a small portion of the main body of liquid refrigerant through the subcooler where it is vaporized for cooling the main body of liquid refrigerant. The subcooler includes small U-shaped concentric inner and outer cylinderical tubes with the vaporized refrigerant in the inner tube flowing directly along the longitudinal axis of the inner tube in parallel relation thereto for cooling the main body of liquid refrigerant flowing in the annulus between the inner and outer tubes along the longitudinal axis of the tubes. FIG. 2 of U.S. Pat. No. 4,577,468 discloses an arrangement in which the vaporized refrigerant leaving the subcooler flows to a separate receiver for further cooling of the liquid refrigerant before the liquid refrigerant enters the evaporator.

Other similar patents included Lathrop U.S. Pat. No. 2,388,556, dated Nov. 6, 1945 which shows a refrigerating system including a subcooler for cooling the refrigerant gas between a low pressure compressor and an a high pressure compressor for a multi-stage compression refrigerating system. The subcooler cools the compressed refrigerant discharged from the low pressure compressor before it enters the intake of the high pressure compressor to remove excess heat from the low pressure gas. The liquid refrigerant is partially flashed in the subcooler and the flashed vaporized refrigerant is drawn off at the high stage compressor suction pressure to the high stage compressor.

U.S. Pat. No. 2,051,971, dated Aug. 25, 1936 relates to a refrigeration system having a heat interchanger which precools liquid refrigerant before the liquid refrigerant is delivered to the expansion valve for the evaporator with the liquid refrigerant being cooled by vaporized refrigerant from the suction line of the evaporator.

SUMMARY OF THE INVENTION

The present invention is particularly directed to a latent heat precooler or subcooler for refrigerant being supplied to a heat exchanger, such as a condenser or an evaporator, in a single compressor refrigeration system for reducing the temperature of the refrigerant before it enters the heat exchanger thereby to provide a more efficient system by reducing the cycle time and the amperage required for operation of the system. The subcooler utilizes the latent heat of a small portion of the hot condensate to precool the main portion of the condensate prior to its passing through the expansion device into the heat exchanger. As a result the cooling capacity of the refrigerant flowing through the heat exchanger can be substantially increased.

A small portion of the main body of liquid refrigerant is diverted from the main refrigerant flow at the subcooler and is passed in the subcooler in a heat exchange relation along the path of the main refrigerant flow in two complete passes or flow paths, one path of diverted cooling refrigerant being in the same direction of flow as the main body of refrigerant and the other path of diverted cooling refrigerant being in a parallel opposite direction of flow to the main body of refrigerant flow through the subcooler. In order to provide a maximum heat exchange contact between the liquid and vaporized refrigerants in the subcooler, one of the refrigerants is passed through a helical coiled tube within an inner tubular member.

Thus, after the first pass of the refrigerant stream in heat exchange relation to the main body of refrigerant, any liquid refrigerant that remains is vaporized in the second pass of the refrigerant in heat exchange relation to the main body of refrigerant thereby to obtain maximum full utilization of the latent heat potential of the cooling refrigerant stream. A subcooler of a relatively small length and of a compact nature is thereby provided.

The compact subcooler includes an inner tubular member mounted in concentric spaced relation within an outer tubular member to form an annulus between the outer periphery of the inner tubular member and the inner periphery of the outer tubular member. The annulus provides a flow path for the vaporized liquid to complete its second or reverse path in a direction of flow opposite the flow of the main body of refrigerant thereby to provide a two step cooling arrangement with the diverted cooling refrigerant being utilized for cooling in heat exchange relation to the main body of refrigerant along a total travel path double that previously employed by a subcooler of a similar length. The inner tubular or cylindrical member provides the function normally performed by subcoolers heretofore by separating the diverted refrigerant from the main body of refrigerant and passing the same through the subcooler in heat exchange relation, such as by having a helical tubular coil within the inner housing for flow of one of the refrigerants. The outer tubular or cylindrical housing which forms the annulus about the inner housing for the reverse flow of vaporized cooling refrigerant after being discharged from the inner housing provides additional subcooling of the main body of refrigerant passing through the subcooler thereby providing a further lowering of the temperature of the main body of refrigerant flow through the subcooler.

It is an object of this invention to provide a subcooler for refrigerant to a heat exchanger in an air conditioning or refrigeration system having a condenser, an evaporator, and a compressor.

It is a further object of this invention to provide such a subcooler that diverts a portion of the main body of refrigerant at the subcooler to cool the main body of refrigerant flowing through the subcooler with the diverted refrigerant being vaporized to absorb heat from the main body of refrigerant and the subcooler having a generally cylindrical housing receiving one of the refrigerants with a relatively large diameter helically coiled tubing with the housing receiving the other refrigerant therein in heat exchange relation. Such a large diameter coiled tubing with the adjacent coils being closely spaced from each other provides a large surface area for the exchange of heat thereby to maximize the absorption of heat from the main body of refrigerant passing through the subcooler.

An additional object of the invention is to provide such a subcooler in the flow path between the compressor and condenser for cooling hot gaseous refrigerant being conducted to the condenser from the compressor.

Another object of the invention is to provide a subcooler in the flow path between the condenser and the evaporator for cooling liquid refrigerant being conducted from the condenser to the evaporator.

A further object of the invention is to provide such a subcooler in which the diverted portion of refrigerant absorbs heat from the main body of refrigerant in two complete passes or continuous flow paths along the length of the subcooler, one path or pass being a direct path in the same direction as the main body of refrigerant flow and the other path being a parallel reverse path opposite the direction of the main body of refrigerant flow.

DESCRIPTION OF THE INVENTION

A conventional refrigeration system includes a gaseous refrigerant which has its temperature and pressure increased by a compressor and is then discharged to a condenser where the gaseous refrigerant is condensed to a liquid refrigerant. The liquid refrigerant then is conducted to an evaporator and passes through an expansion device which provides a pressure drop before the liquid refrigerant enters the evaporator so that the liquid refrigerant vaporizes to a gas in the evaporator thereby absorbing heat energy from the fluid to be cooled. The gaseous refrigerant is then returned to the compressor through a suction line from the evaporator to complete the refrigeration circuit.

Figure 1:
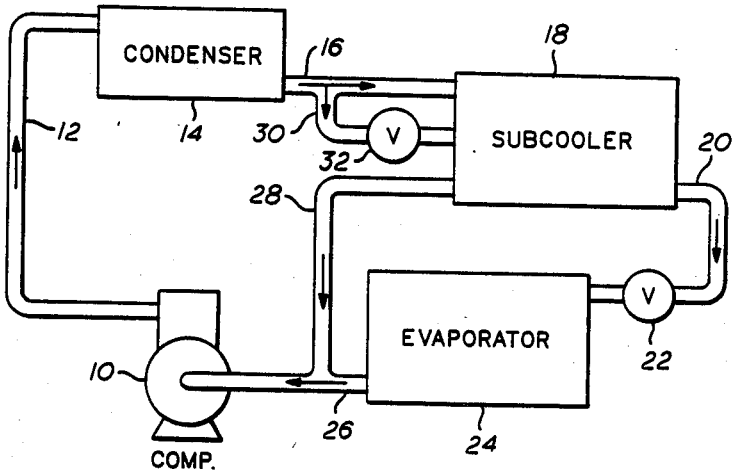
FIG. 1 is a schematic diagram of a refrigeration circuit for use in an air conditioning system incorporating the subcooler comprising the present invention positioned between the condenser and evaporator of the system.

Referring particularly to FIG. 1, the refrigeration circuit or system such as used in an air conditioning system for a residence is illustrated schematically and comprises a compressor 10 having a compressor discharge line 12 for the supply of hot, gaseous refrigerant to the inlet of a condenser 14. Liquid refrigerant is discharged from condenser 14 through line 16 for flow to the subcooler generally indicated at 18 and comprising the present invention. The liquid refrigerant is cooled by subcooler 18 as will be explained hereinafter and is discharged therefrom through line 20 to an expansion valve 22 for flashing the liquid refrigerant prior to entering evaporator 24. A suction line 26 which has a suction exerted thereon by compressor 10 returns gaseous refrigerant to compressor 10. Branch suction line 28 from subcooler 18 likewise has a suction exerted thereon by compressor 10 and connects with main suction line 26 for a return to compressor 10 and commencement of another air conditioning cycle.

Figure 2:
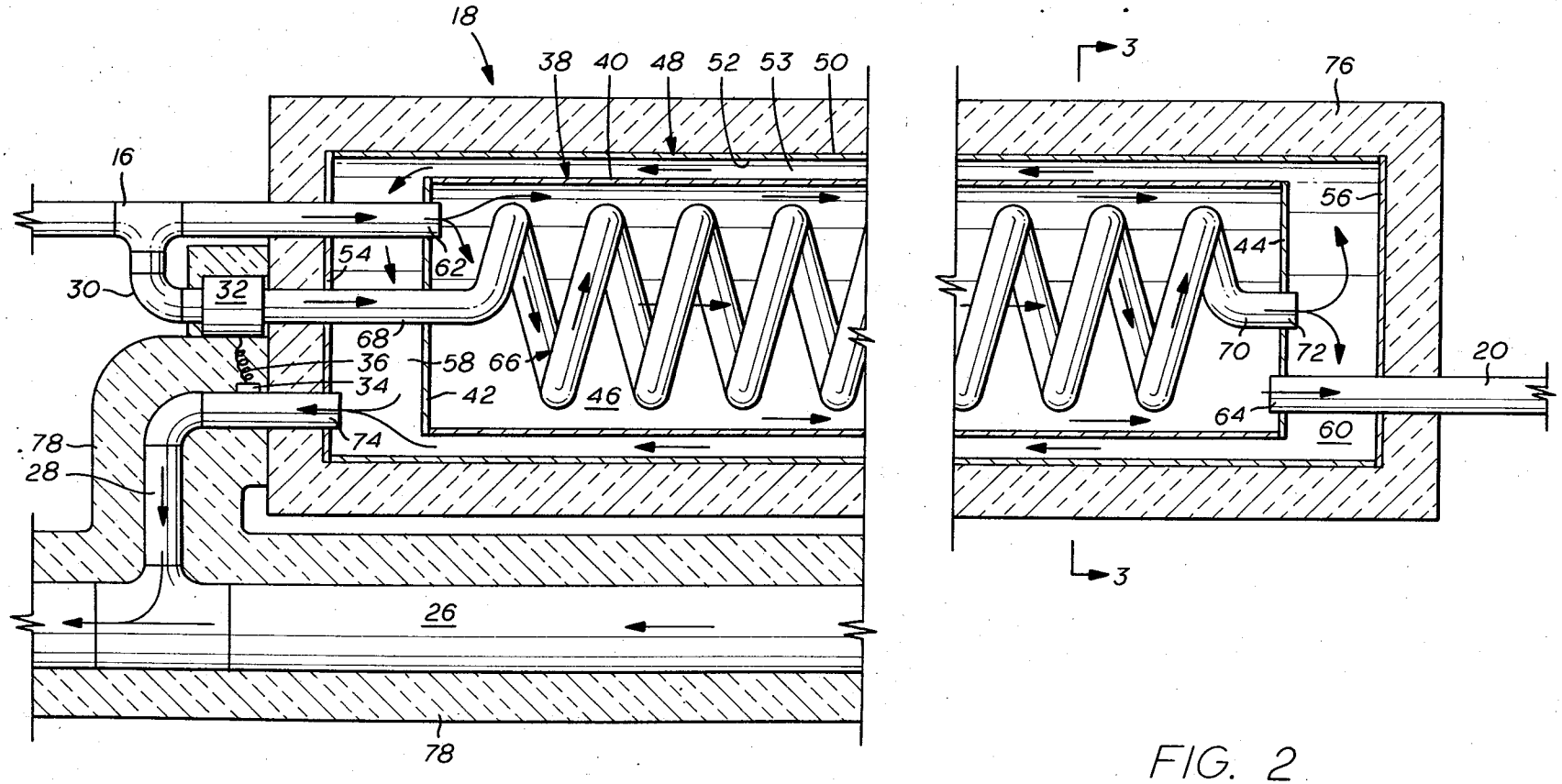
FIG. 2 is a longitudinal sectional view of the subcooler shown in the system of FIG. 1.

Referring now particularly to FIG. 2 in which subcooler 18 is illustrated, a small portion of the main body of liquid refrigerant in line 16 is diverted through a branch line 30 which has an expansion valve 32 therein for vaporizing the small portion of diverted liquid refrigerant before the refrigerant enters subcooler 18. The small portion of diverted refrigerant provides cooling for the main body of refrigerant in line 16 and the diverted refrigerant is drawn from subcooler 18 through suction 28 for bypassing evaporator 24 and returning to compressor 10.

Expansion valve 32 is a thermal expansion valve and utilizes a thermostatic bulb shown at 34 inserted in suction line 28 connected by a line 36 to expansion valve 32. Thermostatic bulb 34 senses the temperature of the vaporized refrigerant entering suction line 28 from precooler 18 for controlling the position of expansion valve 32 and the feeding of diverted refrigerant to subcooler 18. As is well known, thermostatic bulb 34 contains a thermostatic fluid and expansion valve 32 is responsive thereto for varying the rates of flow through valve 32 as desired.

Subcooler 18 comprises an inner tubular housing or shell generally indicated at 38 and including a cylindrical body 40 having inner and outer peripheries and closed by ends 42, 44 thereby to define an inner generally cylindrical fluid chamber 46 receiving the main body of liquid refrigerant from line 16.

An outer concentric tubular housing or shell is generally designed at 48 and is of a cylindrical shape having a cylindrical body 50 defining an inner periphery 52. An annulus 53 is formed between inner periphery 52 of outer housing 50 and the outer periphery of inner housing 38. Housing 50 has closed ends 54 and 56 to define an outlet end fluid chamber 58 between end 42 of inner housing 38 and end 54 of outer housing 48. An inlet end fluid chamber 60 is defined between end 44 of inner housing 38 and end 56 of outer housing 48.

The main body of liquid refrigerant from condenser 14 is supplied through line 16 and inlet opening 62 to fluid chamber 46 of inner housing 38. Line 16 extends through ends 54 and 42 and inlet 62 is in direct fluid communication with fluid chamber 46 of inner housing or shell 38.

An outlet opening 64 at the end of line 20 to evaporator 24 is positioned adjacent end 44 of inner housing 38. Line 20 extends through end fluid chamber 60 and end 56. The main body of liquid refrigerant leaves inner housing 38 through opening 64 and is conducted to expansion valve 22 at evaporator 24 where it is flashed for cooling the air or fluid from an enclosure to be cooled, such as a room or residence.

Branch line 30 which receives the diverted liquid refrigerant extends to expansion valve 32. A tubular helical coil generally indicated at 66 is mounted within fluid chamber 46 and has an inlet end portion 68 connected to expansion valve 32 and extending through ends 42 and 54. Helical coil 66 receives flahsed, diverted refrigerant from expansion valve 32 for absorbing heat from and cooling the main body of refrigerant in fluid chamber 46. An outlet end portion 70 of helical coil 66 has an outlet opening 72 through end 44 and the flow of diverted vaporized refrigerant is discharged from helical tube 66 into end fluid chamber 60 to complete a first pass in heat exchange relation to the main body of refrigerant. Then, to complete a second pass in heat exchange relation to the main body of refrigerant, the discharged refrigerant in fluid chamber 60 then passes along annulus 53 to opposite end fluid chamber 58. Thus, any liquid that remains in the diverted refrigerant is vaporized in the second pass of refrigerant stream flow thereby to obtain full utilization of the latent heat potential of the diverted refrigerant stream. Suction line 28 has an inlet opening 74 at end fluid chamber 58 to receive the diverted vaporized refrigerant after its second pass where it is drawn by suction through lines 28 and 26 to compressor 10 for another cycle. Suitable insulation is shown at 76 for subcooler 10 such as a suitable insulating material having a thickness of around one-half (½) inch, and similar insulation 78 extends about suction lines 26 and 28.

In order for subcooler 18 to absorb a maximum amount of heat from the main body of liquid refrigerant in fluid chamber 46 of inner housing 38, it is necessary that a large surface contact area be provided between the flashed vaporized refrigerant within helical tubular coil 66 and the main body of refrigerant in chamber 46. Thus, tubular coil 66 is designed so that a large surface contact area is exposed to the main body of liquid refrigerant flowing through inner housing 38, and tubular coil 66 occupies a large portion of the diameter of fluid chamber 46 through which the main body of liquid refrigerant flows.

As a non-limiting example of a subcooler 18 which has been found to be satisfactory when utilized in a 3-ton home air conditioning unit, for example, outer tubular housing 48 is formed of a copper tubing having a length of twenty (20) inches, an outside diameter of 3⅛ inches, and a thickness of 1/16 inch, while inner housing 38 is formed of copper tubing having a length of eighteen (18) inches, an outside diameter of 2⅝ inches, and a thickness of 1/16 inch. The copper tubing forming helical tubular coil 66 has an outside diameter of ⅜ inch and a thickness of around 1/32 inch. The outer diameter of coil 66 is two (2) inches with the outer circumference of coil 66 being spaced around ¼ inch from the inner circumference of inner housing 38 thereby to fill a large portion of the area within fluid chamber 46. The length of subcooler 18 while illustrated as being twenty (20) inches is dependent on the size and type of air conditioning unit with which the subcooler is utilized but is generally of a length between around ten (10) inches to thirty (30) inches. Ends 42, 44 of housing 38 are spaced around one (1) inch from ends 54, 56 of outer housing 48. Insulations 76 and 78 are around ½ inch in thickness and are secured to the outer periphery of subcooler 18 and the associated lines by suitable adhesive material. It is noted that compressor 10 provides a suction for both the gaseous refrigerant being discharged from subcooler 18 through line 28 and the gaseous refrigerant being discharged from evaporator 24 through line 26.

Figure 4:
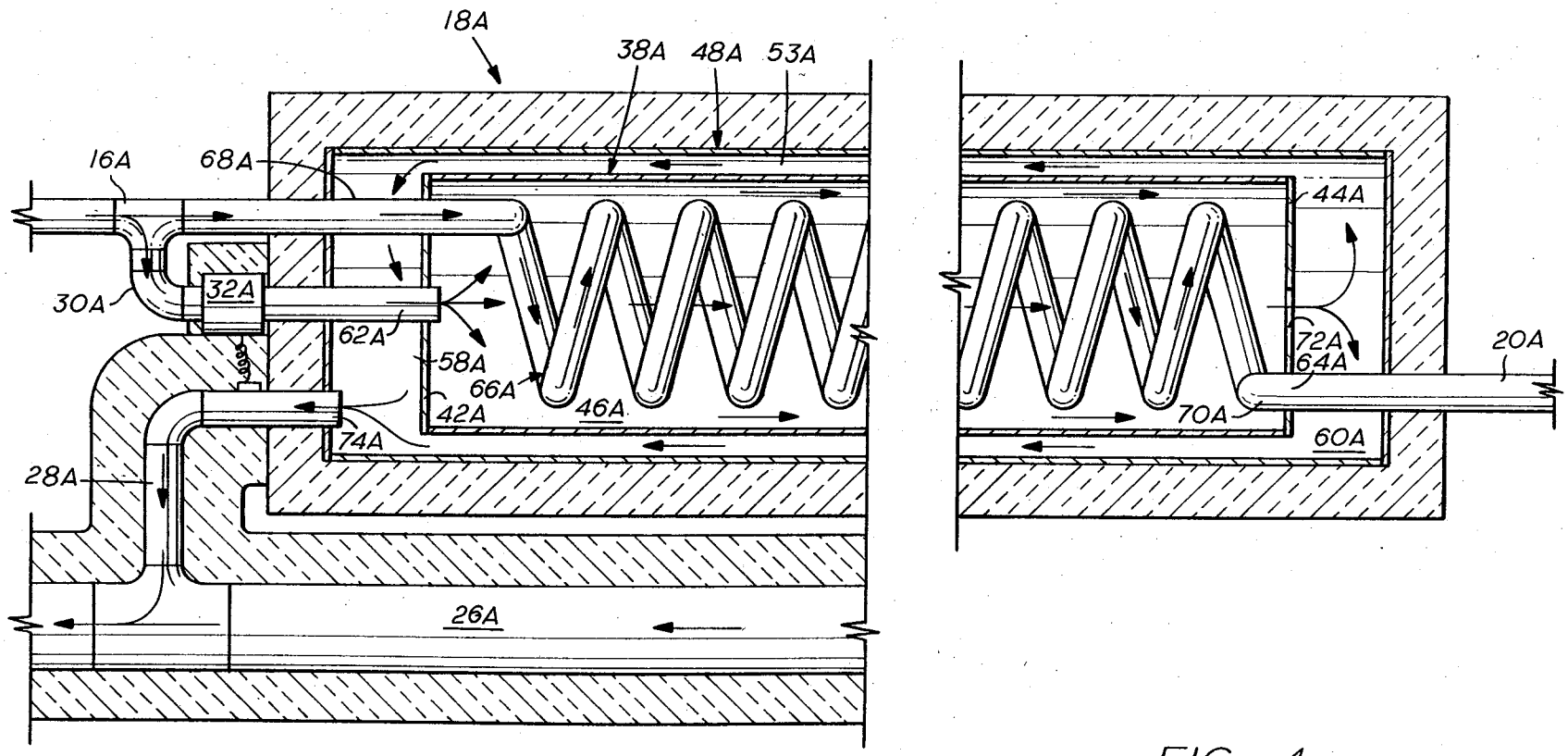
FIG. 4 is a longitudinal sectional view of another embodiment of the subcooler comprising this invention in which the flow of the main body of refrigerant is conducted through a coiled tubing of the subcooler.

Referring now to FIG. 4, a separate embodiment of a subcooler comprising the present invention is shown at 18A in which the main body of refrigerant is directed through the helical tubular coil 66A while the diverted small portion of refrigerant passes through fluid chamber 46A of inner housing 38A in heat exchange relation to the main body of refrigerant. The main body of refrigerant from line 16A flows through end portion 68A of tubular helical coil 66A adjacent closed end 42A of inner housing 38A. The main body of liquid refrigerant passes through end portion 70A of tubular coil 66A through opening 64A in end 44A of housing 38A. The diverted vaporized refrigerant enters chamber 46A through line 62A from expansion valve 32A and branch line 30A which receives the diverted liquid refrigerant from main line 16A. Line 62A provides an inlet for the discharge of vaporized refrigerant into chamber 46A. An outlet opening 72A through end 44A supplies the vaporized refrigerant to end fluid chamber 60A to complete one pass and to commence a second pass along annulus 53A to chamber 58A. Chamber 58A has an outlet opening 74A to suction line 28A connected to main suction line 26A from the evaporator for return of vaporized refrigerant to the compressor and the commencement of another cycle.

Figure 3:
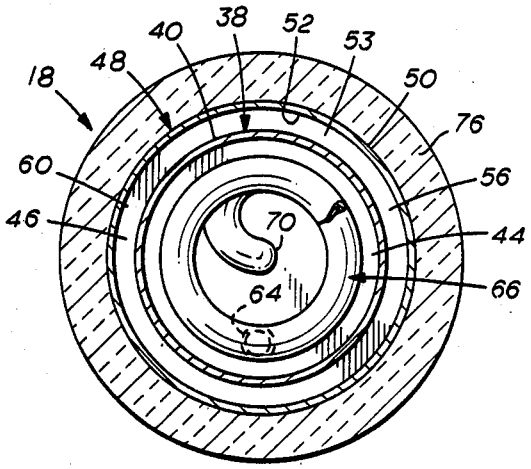
FIG. 3 is a section taken generally along the line 3—3 of FIG. 2.

Thus, the primary difference in the embodiment comprising subcooler 18A shown in FIG. 4 and the embodiment comprising subcooler 18 shown in FIGS. 2 and 3 is in the flow paths of the refrigerant through the subcooler.

In order to verify that such a latent heat subcooling device provides a more efficient operation, a test system was designed and fabricated for system testing. The system was designed so that conditions surrounding the evaporator and the condenser could be closely monitored and controlled. The cycle itself was instrumented so that the behavior of the refrigerant could be measured rather than to depend on the more convenient but less accurate measurement of the air flowing through the evaporator and condenser as is usually done. Refrigerant pressures and temperatures, and compressor amperage along with air temperatures were measured continuously during operation of the system.

The evaporator and condenser sections of the system were located in different rooms so that control of their respective environments could be achieved. The evaporator provided cooled air to a separate room in which a thermostat was located. In the condenser room, air was discharged from the condenser to an area outside the room following passage of air through the condenser. With this sytem, very close control of the air conditions around the evaporator and the condenser were achieved.

The air conditioning system tested utilized a WinterKing 3-ton unit rated at 9.20 SEER, a 230 volt compressor, and an evaporator cfm of 1500, with Freon 22 being used as the refrigerant. Several tests were conducted to compare the energy consumption of such an air conditioning system without the use of a subcooler against such an air conditioning system utilizing subcooler 18 shown in the embodiment of FIGS. 2 and 3, and subcooler 18A shown in the embodiment of FIG. 4.

Such tests were conducted under conditions in which the air surrounding the condenser was maintained at 95 degrees F., the thermostat temperature was set at 66 degrees F. to maintain a reasonable cycling time, and where all other conditions were maintained as close to uniform as possible. The tests indicated a reduction of energy consumption of 28.4 percent for the embodiment of FIGS. 2 and 3, and a reduction of 21.8 percent for the embodiment of FIG. 4, as compared with the system without a refrigerant subcooler. It was found that the use of subcoolers resulted in a substantial lower temperature and a slightly lower pressure at the refrigerant outlet of the condenser. This provided reduced amperage for the refrigeration cycle to lower the energy consumption.

Figure 5:
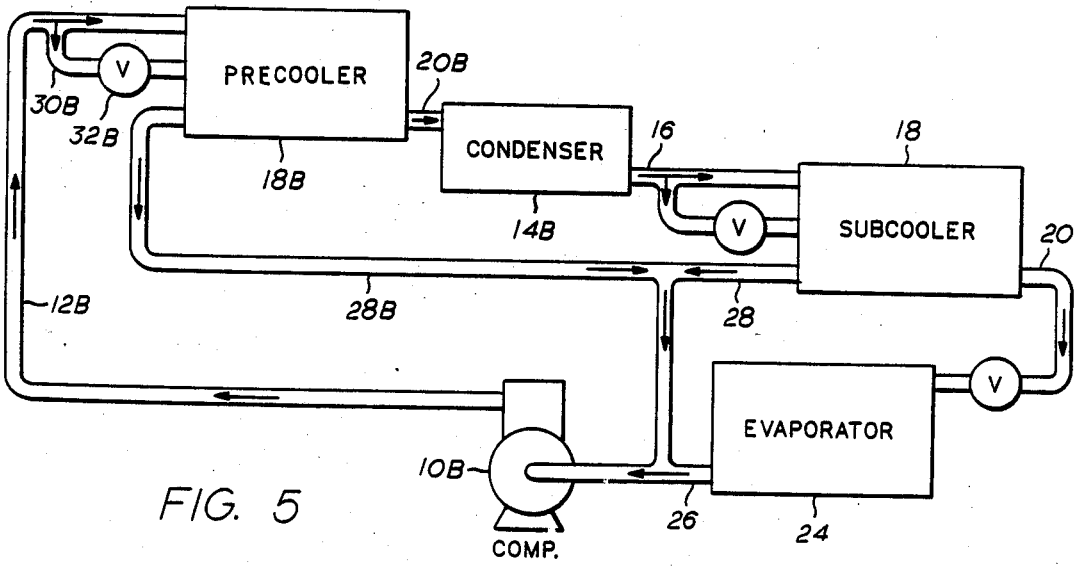
FIG. 5 is a schematic diagram of a modified air conditioning system in which another subcooler comprising the present invention is positioned between the compressor and condenser of the system in addition to the subcooler between the condenser and evaporator.

It may be desirable under certain conditions to provide a precooler or subcooler between the compressor and the condenser for subcooling the refrigerant hot gas from the compressor before it enters the condenser. For this purpose, an air conditioning refrigeration system is shown in FIG. 5 in which a precooler or subcooler 18B is provided between compressor 10B and condenser 14B for precooling or subcooling the refrigerant hot gas from compressor 10B. The hot gaseous or vaporized refrigerant is conducted through line 12B to precooler 18B and a small portion of the refrigerant hot gas is diverted through branch line 30B to an expansion valve 32B for being flashed to precooler 18B in the same manner as in subcooler 18 of the embodiment shown and described in FIGS. 2 and 3, or the embodiment of FIG. 4. The main body of gaseous or vaporized refrigerant passing from precooler 18B is conducted to condenser 14B through line 20B. The small portion of diverted gaseous refrigerant which has been utilized for precooling the main body of gaseous refrigerant is discharged through suction line 28B for return to compressor 10B through line 26 under the suction of compressor 10B for commencement of another cycle. The remainder of the refrigeration or air conditioning system shown in FIG. 5 functions in the same manner as the system shown in FIG. 1 utilizing subcooler 18 shown in FIGS. 2 and 3, or subcooler 18A shown in FIG. 4. Condenser 14B supplies cool refrigerant to evaporator 24 through line 20 and suction line 26 returns vaporized refrigerant to compressor 10B. Compressor 10B increases the temperature and pressure of the vaporized refrigerant from subcooler 18, precooler 18B and evaporator 24 for the commencement of another cycle.

Precooler 18B may be used in combination with subcooler 18 as shown in FIG. 5 or may be employed separately, as desired. Further, the embodiment of the subcooler shown at 18A in FIG. 4 may be utilized, if desired, for precooler 18B. Thus, it is apparent that the present invention is applicable for precooling or subcooling both liquid refrigerant and hot gaseous refrigerant by utilizing the same method and apparatus.

While the term "precooler" is normally employed for a device to lower the temperature of hot gaseous refrigerant, and the term "subcooler" is normally employed for a device to lower the temperature of liquid refrigerant, the term "subcooler" as used in the specification and claims herein shall be interpreted as including a device for the lowering of the temperature of hot gaseous refrigerant as well as liquid refrigerant, unless specifically defined otherwise.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In an air conditioning system having a compressor, a first heat exchange means connected to the compressor for receiving refrigerant therefrom, a second heat exchange means connected to the first heat exchange means for receiving liquid refrigerant therefrom; and suction line means between the second heat exchange means and the compressor for routing refrigerant from the second heat exchanger means to the compressor; an improved refrigerant subcooler for at least one of said heat exchange means for supplying subcooled refrigerant thereto, said improved subcooler comprising:

an elongate outer tubular housing having an inlet end and an outlet end for refrigerant to said one of said heat exchange means;

an elongate inner tubular housing positioned within said outer tubular housing in a generally concentric relation to said outer tubular housing and defining an annulus between the outer periphery of said inner housing and the inner periphery of said outer housing, said inner housing having an inlet end and an outlet end in inwardly spaced relation to the respective inlet and outlet ends of said outer housing;

a refrigerant main supply line connected to said inner tubular housing adjacent the inlet end thereof to supply refrigerant to be cooled to said inner tubular housing;

a refrigerant inlet branch line diverging from the main supply line adjacent the inlet end of the inner housing and connected to the inner tubular housing to divert a relatively small portion of the main body of refrigerant from the main supply line to the inner tubular housing for flowing from the inlet end to the outlet end of said inner housing and cooling the main body of refrigerant therein;

an expansion valve in said inlet branch line adjacent the inlet end of said inner housing for vaporizing the refrigerant therein;

means within the inner tubular housing to separate the diverted refrigerant therein from the main body of refrigerant to be cooled during simultaneous flow of the refrigerants in a first pass from said inlet end of the inner housing to the outlet end thereof such that the diverted refrigerant absorbs heat from the main body of refrigerant;

a refrigerant outlet line from the outlet end of said inner housing to said one of said heat exchange means to supply the main body of subcooled refrigerant thereto;

means adjacent said outlet end of the inner housing to direct the diverted vaporized refrigerant being discharged thereat from the inner housing into the annulus between the inner and outer housings for a second reverse pass of the vaporized refrigerant in an opposite direction along the annulus from the outlet end of said inner housing to said inlet end thereof such that the vaporized refrigerant in the annulus absorbs heat from the refrigerant within the inner housing during flow along the annulus; and outlet line means adjacent said inlet end of said inner housing to conduct the flow of gaseous refrigerant from the annulus to said suction line means for flow to the compressor.

2. In an air conditioning system as set forth in claim 1 wherein said at least one of said heat exchange means comprises an evaporator and said subcooler supplies liquid refrigerant to the evaporator.

3. In an air conditioning system as set forth in claim 1 wherein said at least one of said heat exchange means comprises a condenser and said subcooler supplies vaporized refrigerant to the condenser.

4. In an air conditioniong system as set forth in claim 1 wherein said first heat exchange means comprises a condenser and said second heat exchange means comprises an evaporator.

5. In an air conditioning system as set forth in claim 1 wherein both said inner housing and said outer housing are of a generally cylindrical shape having opposed closed ends, the closed ends of said inner housing being spaced inwardly of the closed ends of said outer housing to provide opposed end fluid chambers in fluid communication with the annulus between said first and second housings.

6. In an air conditioning system as set forth in claim 1 wherein a tubular helical coil is mounted within said inner housing and receives said diverted refrigerant therein for flow through said inner housing in said first pass with said main body of refrigerant surrounding said coil and flowing in a stream through the inner housing in heat exchange relation to said helical coil.

7. In an air conditioning system as set forth in claim 1 wherein a tubular helical coil is mounted within said housing and receives the main body of refrigerant therein for flow through said inner housing, said diverted refrigerant flowing in a stream through the inner housing in heat exchange relation to said helical coil in said first pass.

8. In an air conditioning system having a compressor, a condenser connected to the compressor for receiving refrigerant therefrom, an evaporator connected to the condenser for receiving liquid refrigerant from the condenser, and a suction line means between the evaporator and compressor for routing refrigerant from the evaporator to the compressor; an improved subcooler between the condenser and the evaporator for receiving liquid refrigerant from the condenser and supplying liquid refrigerant to the evaporator at a temperature lower than the temperature of the liquid refrigerant received from the condenser, said improved subcooler comprising:

an elongate outer tubular housing having an inlet end and an outlet end for refrigerant to said one of said heat exchange means;

an elongate inner tubular housing positioned within said outer tubular housing in a generally concentric relation to said outer tubular housing and defining an annulus between the outer periphery of said inner housing and the inner periphery of said outer housing, said inner housing having an inlet end and an outlet end in inwardly spaced relation to the respective inlet and outlet ends of said outer housing;

a liquid refrigerant inlet main line from the condenser connected to said inner tubular housing adjacent the inlet end thereof to suppy liquid refrigerant to be cooled to said tubular housing;

a refrigerant inlet branch line diverging from the main inlet line adjacent the inlet end of the inner housing and connected to the inner tubular housing to divert a portion of the main body of liquid refrigerant from the main line to the inner tubular housing for vaporizing and cooling the main body of refrigerant therein during flow from the inlet end of said inner housing to the outlet end thereof;

an expansion valve in said inlet branch line for vaporizing the refrigerant therein;

means within the inner tubular housing to separate the diverted vaporized refrigerant therein from the main body of liquid refrigerant therein to be cooled during simultaneous flow of the vaporized and liquid refrigerants in a first pass from said inlet end of the inner housing to the outlet end thereof such that the vaporized diverted refrigerant absorbs heat from the main body of liquid refrigerant;

a refrigerant outlet line from the outlet end of said inner housing to said evaporator to supply the main body of subcooled liquid refrigerant thereto;

means adjacent said outlet end of the inner housing to direct the diverted vaporized refrigerant being discharged thereat from the inner housing into the annulus between the inner and outer housings for a second reverse pass of he diverted vaporized refrigerant in an opposite direction along the annulus for the length of the inner housing to said inlet end of said housing such that the vaporized refrigerant in the annulus absorbs heat from the refrigerant within the inner housing during flow along the annulus; and outlet line means adjacent said inlet end of said inner housing to conduct the flow of gaseous refrigerant from the annulus to said suction line means for flow to the compressor.

9. In an air conditioning system as set forth in claim 8 wherein both said inner housing and said outer housing are of a generally cylindrical shape having opposed closed ends, the closed ends of said inner housing being spaced inwardly of the closed ends of said outer housing to provide opposed end fluid chambers in fluid communication with the annulus between said first and second housings.

10. In an air conditioning system as set forth in claim 8 wherein a tubular helical coil is mounted within said inner housing and receives said diverted refrigerant therein for flow through said inner housing in said first pass, said main body of refrigerant flowing in a stream through the inner housing in heat exchange relation to said helical coil.

11. In an air conditioning system as set forth in claim 8 wherein a tubular helical coil is mounted within said housing and receives the main body of refrigerant therein for flow through said inner housing, said diverted refrigerant flowing in a stream through the inner housing in heat exchange relation to said helical coil in said first pass.

12. In an air conditioning system having a compressor, a condenser connected to the compressor for receiving refrigerant therefrom, an evaporator connected to the condenser for receiving liquid refrigerant from the condenser, and a suction line means between the evaporator and compressor for routing refrigerant from the evaporator to the compressor; an improved subcooler between the compressor and the condenser for receiving heat vaporized refrigerant from the condenser and supplying vaporized refrigerant to the condenser at a temperature lower than the temperature of the refrigerant received from the compressor, said improved subcooler comprising:

a elongate outer tubular housing having an inlet end and an outlet end for refrigerant to said one of said heat exchange means;

a elongate inner tubular housing positioned within said outer tubular housing in a generally concentric relation to said outer tubular housing and defining an annulus between the outer periphery of said inner housing and the inner periphery of said outer housing, said inner housing having an inlet end and an outlet end in inwardly spaced relation to the respective inlet and outlet ends of said outer housing;

a refrigerant inlet main line from the compressor connected to said inner tubular housing adjacent the inlet end thereof to supply vaporized refrigerant to be cooled to said tubular housing;

a refrigerant inlet branch line diverging from the main inlet line adjacent the inlet end of the inner housing and connected to the inner tubular housing to divert a portion of the main body of vaporized refrigerant from the main line to the inner tubular housing for cooling the main body of refrigerant therein during flow from the inlet end of said inner housing to the outlet end thereof;

an expansion valve in said inlet branch line for vaporizing the refrigerant therein;

means within the inner tubular housing to separate the diverted vaporized refrigerant therein from the main body of vaporized liquid refrigerant therein to be cooled during simultaneous flow of the diverted and main body of vaporized refrigerants in a first pass from said inlet end of the inner housing to the outlet end thereof such that the vaporized diverted refrigerant absorbs heat from the main body of vaporized refrigerant;

a refrigerant outlet line from the outlet end of said inner housing to said condenser to supply the main body of subcooled vaporized refrigerant thereto;

means adjacent said outlet end of the inner housing to direct the diverted vaporized refrigerant being discharged thereat from the inner housing into the annulus between the inner and outer housings for a second reverse pass of the diverted vaporized refrigerant in an opposite direction along the annulus to said inlet end of said housing such that the vaporized refrigerant in the annulus absorbs heat from the refrigerant within the inner housing during flow along the annulus; and outlet line means adjacent said inlet end of said inner housing to conduct the flow of gaseous refrigerant from the annulus to said suction line means for flow to the compressor.

13. In an air conditioning system as set forth in claim 12 wherein both said inner housing and said outer housing are of a generally cylindrical shape having opposed closed ends, the closed ends of said inner housing being spaced inwardly of the closed ends of said outer housing to provide opposed end fluid chambers in fluid communication with the annulus between said first and second housings.

14. In an air conditioning system as set forth in claim 12 wherein a tubular helical coil is mounted within said inner housing and receives said diverted refrigerant therein for flow through said inner housing in said first pass, said main body of refrigerant flowing in a stream through the inner housing in heat exchange relation to said helical coil.

15. In an air conditioning system as set forth in claim 12 wherein a tubular helical coil is mounted within said housing and receives the main body of refrigerant therein for flow through said inner housing, said diverted refrigerant flowing in a stream through the inner housing in heat exchange relation to said helical coil in said first pass.

16. An improved refrigerant subcooler for a heat exchange means in a refrigeration system for supplying subcooled refrigerant to the heat exchange means, said improved subcooler comprising:

an elongate outer tubular housing having closed opposed inlet and outlet ends;

an elongate inner tubular housing having opposed closed inlet and outlet ends spaced inwardly from the closed ends of said outer tubular housing and positioned within said outer tubular housing in a generally concentric relation to said outer tubular housing to define an annulus between the outer periphery of said inner housing and the inner periphery of said outer housing extending for the entire length of said inner tubular housing;

a refrigerant main supply line connected to said inner tubular housing adjacent the inlet end thereof to supply refrigerant to be cooled to the inside of said tubular housing;

a refrigerant inlet branch line diverging from the main supply line adjacent the inlet end of the inner housing and connected to the inner tubular housing to divert a portion of the main body of refrigerant from the main supply line to the inner tubular housing for cooling the main body of refrigerant therein;

an expansion valve in said inlet branch line for vaporizing refrigerant therein;

means within the inner tubular housing to separate the diverted refrigerant therein from the main body of refrigerant to be cooled during simultaneous flow of the refrigerants in a first pass from said inlet end of the inner housing to the outlet end thereof such that the diverted refrigerant absorbs heat from the main body of refrigerant;

a refrigerant outlet line from the outlet end of said inner housing to said heat exchange means to supply the main body of subcooled refrigerant thereto;

means adjacent said outlet end of the inner housing to direct the diverted vaporized refrigerant being discharged thereat from the inner housing into the annulus between the inner and outer housings for a second reverse pass of the vaporized refrigerant in an opposite direction along the annulus to said inlet end of said housing such that the vaporized refrigerant in the annulus absorbs heat from the refrigerant within the inner housing during flow along the annulus; and outlet line means adjacent said inlet end of said inner housing to conduct the flow of gaseous refrigerant from the annulus.

* * * * *